US007650972B2

(12) United States Patent
Aulanko et al.

(10) Patent No.: US 7,650,972 B2
(45) Date of Patent: Jan. 26, 2010

(54) ELEVATOR

(75) Inventors: Esko Aulanko, Kerava (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/486,177

(22) Filed: Jul. 14, 2006

(65) Prior Publication Data

US 2006/0289246 A1 Dec. 28, 2006

Related U.S. Application Data

(63) Continuation of application No. PCT/FI2005/000154, filed on Mar. 17, 2005.

(30) Foreign Application Priority Data

Mar. 26, 2004 (FI) ..... 20040461

(51) Int. Cl.
*B66B 5/00* (2006.01)
*B66B 5/28* (2006.01)

(52) U.S. Cl. ..... 187/350; 187/343

(58) Field of Classification Search ..... 187/343, 187/350

See application file for complete search history.

(56) References Cited

U.S. PATENT DOCUMENTS 216,568 A * 6/1879 Holske ..... 187/251
5,307,904 A * 5/1994 Yoo ..... 187/343
5,398,781 A * 3/1995 Biewald et al. ..... 187/264
5,513,724 A * 5/1996 De Jong ..... 187/264
6,131,017 A 10/2000 Lebby et al.
6,193,017 B1 * 2/2001 Koster ..... 187/258
2004/0222046 A1 * 11/2004 Gut ..... 187/343

FOREIGN PATENT DOCUMENTS

GB 1442584 7/1976
WO WO 2004/041704 A1 5/2004
WO WO 2004/067429 A1 8/2004

* cited by examiner

*Primary Examiner*—John Q. Nguyen
*Assistant Examiner*—Eric Pico
(74) *Attorney, Agent, or Firm*—Harness, Dickey & Pierce, P.L.C.

(57) ABSTRACT

An elevator may include an elevator car, hoisting ropes, traction sheave, and compensating device. The hoisting ropes may support the elevator car. The traction sheave may move the elevator car using the hoisting ropes. The elevator may include rope portions of the hoisting ropes going upwards and downwards from the elevator car. A rope portion going from the traction sheave in a direction of the rope portions going upwards from the elevator car may be under a first rope tension. A rope portion going from the traction sheave in a direction of the rope portions going downwards from the elevator car may be under a second rope tension. The compensating device may do one or more of the following: equalize rope tension, compensate the rope tension, equalize rope elongation, compensate the rope elongation, and render a ratio of the first rope tension to the second rope tension substantially constant.

13 Claims, 3 Drawing Sheets

ELEVATOR

PRIORITY STATEMENT

Figure 1:
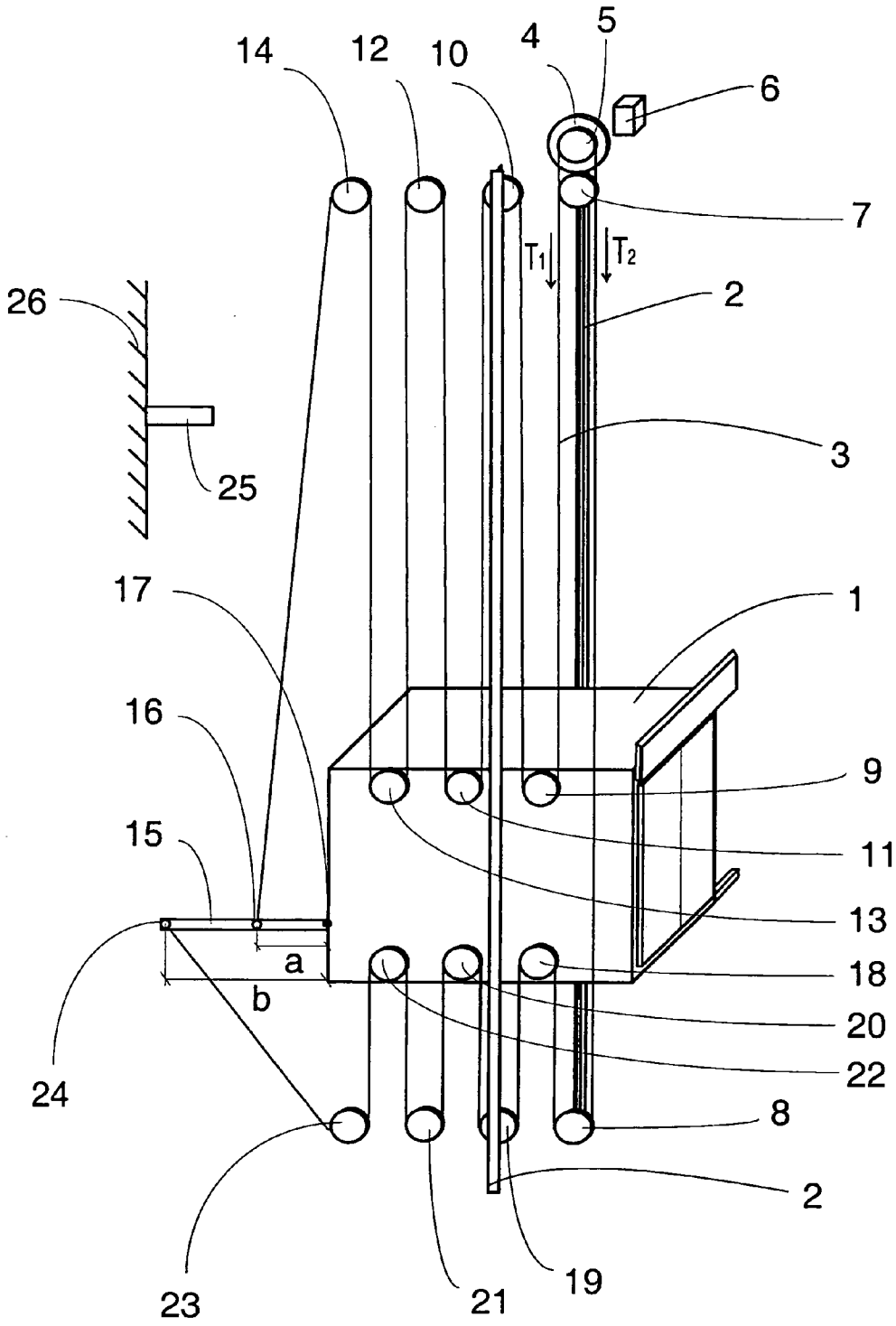

This application is a continuation of PCT/FI 2005/000154, filed Mar. 17, 2005, which is an international application of Finish Patent Application No. 20040461 filed on Mar. 26, 2004, the disclosures of both of which are incorporated herein by reference in their entirety.

SUMMARY

The present invention relates to an elevator as defined in the preamble of claim 1 and to a method as defined in the preamble of claim 10 for preventing and/or stopping the motion of an elevator.

One of the objectives in elevator development work is to achieve an efficient and economical utilization of building space. In recent years, this development work has produced various elevator solutions without machine room and without counterweight, among other things. Good examples of elevators without machine room and without counterweight are disclosed in specifications FI 20021959 and FI 20030153. The elevators described in these specifications are fairly efficient in respect of space utilization as they have made it possible to eliminate the space required by the elevator machine room in the building and the space required by the counterweight in the elevator shaft without a need to enlarge the elevator shaft.

In these basically good elevator solutions, the space required by the hoisting machine limits the freedom of choice in elevator lay-out solutions. Some space is needed to provide for the passage of the hoisting ropes. Stopping the motion of the elevator car at a desired point especially in situations where the elevator is driven onto the buffers fitted in the elevator shaft space below or above the elevator car or when the car is to be prevented from going too far up. In modernization of elevators, the space available in the elevator shaft has often limited the sphere of application of the concept of elevator without machine room. Especially when hydraulic elevators are to be modernized or replaced, it is not practical to apply an elevator solution without machine room due to a lack of space in the elevator shaft especially in a situation where the hydraulic elevator to be modernized or replaced has no counterweight. Ensuring a safety space in the shaft is also a problematic task in connection with elevator solutions without counterweight, especially ensuring a safety space above the elevator car and stopping an upward motion of the elevator.

The aim of the invention is to achieve at least one the following objectives. On the one hand, it is an objective of the invention to develop the elevator without machine room so as to achieve more efficient space utilization in the building and in the elevator shaft than before. This means that the elevator should permit of being installed in a relatively narrow elevator shaft if necessary. On the other hand, it is an objective of the invention to achieve an elevator, preferably an elevator without counterweight, wherein it is possible to prevent and stop the motion of the elevator at a desired point in order to form the required safety space in the elevator shaft, especially in situations where a serviceman wants to go onto the top of the car. It is an objective to ensure a safety space in the elevator and to prevent it from being driven too far up.

The elevator of the invention is characterized by what is disclosed in the characterization part of claim 1, the method of the invention is characterized by what is disclosed in the characterization part of claim 10, and the use of the invention is characterized by what is disclosed in claim 11. Other embodiments of the invention are characterized by what is disclosed in the other claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit subtasks or in respect of advantages or sets of advantages achieved. In this case, some of the attributes contained in the claims below may be superfluous from the point of view of separate inventive concepts.

By applying the invention, one or more of the following advantages, among others, can be achieved:

- the motion of the elevator of the invention can be stopped at a desired point in a simple and easy manner
- the upper safety space of the elevator can be easily ensured by applying the invention
- the safety and reliability of the elevator of the invention are improved
- the elevator and method of the invention are cheap solutions to implement
- as the motion of the elevator is prevented/stopped by means of a gripping element at a point as close to the hoisting machine as possible, the delay caused by the elongation of the rope is as small as possible and the elevator car stops within a short distance
- in addition, as the motion is stopped by a point as close to the hoisting machine as possible, the rope force required to keep the elevator car immovable is as small as possible
- when the elevator and method of the invention are used, savings in material and installation costs are achieved as compared to prior-art heavy and expensive structures in which a buffer is used, upward motion of the elevator car is easy to stop and when downward travel of the elevator is again started, the gripping element can be released automatically, allowing the elevator to move normally and the compensating gear to function in the normal way.

The primary area of application of the invention is elevators designed for transporting people and/or goods. A normal area of application of the invention is in elevators whose speed range is about or below 1.0 m/s but may also be higher. For example, an elevator traveling at a speed of 0.6 m/s is easy to implement according to the invention.

In both passenger and freight elevators, many advantages provided by the invention are pronouncedly apparent even in elevators for only 2-4 persons, and emphatically apparent already in elevators for 6-8 persons (500-630 kg).

In the elevator of the invention, normal elevator ropes, such as generally used steel wire ropes, are applicable. The elevator may use ropes of synthetic material and rope structures with a synthetic-fiber load-bearing part, such as e.g. so-called "aramid" or kevlar ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. Using round wires, the rope can be twisted in many ways using wires of the same or different thicknesses. In ropes well applicable with the invention, the wire thickness is below 0.4 mm on an average. Well-suited ropes made from strong wires are those in which the average wire thickness is under 0.3 mm or even under 0.2 mm. For example, thin-wired and strong 4-mm ropes can be twisted relatively advantageously from wires such that the average wire thickness in the finished ropes is between 0.15 . . . 0.25 mm, the thinnest wires having a thickness even as small as 0.1 mm. Thin rope wires can easily be made quite strong. In the invention it is possible to use rope wires having a strength e.g. as high as about 2000 N/mm$^2$. Appropriate rope wire strengths are 2100-2700 N/mm$^2$. In principle, it is possible to use rope wires of a strength of about 3000 N/mm$^2$ or even more.

The elevator of the invention, in which the elevator car is supported by a set of hoisting ropes comprising one rope or a number of parallel ropes, and which has a traction sheave that moves the elevator car by means of the hoisting ropes, comprises hoisting rope portions going upwards and downwards from the elevator car, and the rope portions starting from the elevator car in the direction of the upper rope portion are under a first rope tension ($T_1$) and the rope portions starting from the elevator car in the direction of the lower rope portion are under a second rope tension ($T_2$). In addition, the elevator comprises a compensating device acting on the hoisting ropes to equalize and/or compensate the rope tension and/or rope elongation and/or to render the ratio of the first and the second rope tensions ($T_1/T_2$) substantially constant. The motion of the elevator is prevented and/or stopped by increasing the ratio of the first rope tension ($T_1$) to the second rope tension ($T_2$).

In the method of the invention for preventing/stopping the motion of an elevator, in which elevator the elevator car is at least partially supported by a set of hoisting ropes comprising one rope or a number of parallel ropes. The elevator has a traction sheave which moves the elevator car by means of the hoisting ropes, and which elevator has hoisting rope portions going upwards and downwards from the elevator car. The rope portions going from the traction sheave in the direction of the rope portion above the elevator car are under a first rope tension ($T_1$) and the rope portions going from the traction sheave in the direction of the rope portion below the elevator car are under a second rope tension ($T_2$). The elevator has a compensating device acting on the hoisting ropes to equalize and/or compensate the rope tension and/or rope elongation and/or to render the ratio of the first and the second rope tensions ($T_1/T_2$) substantially constant. In the method, the motion of the elevator is prevented and/or stopped by increasing the ratio of the first rope tension ($T_1$) to the second rope tension ($T_2$).

By increasing the contact angle using a rope pulley that functions as a diverting pulley, the grip between the traction sheave and the hoisting ropes can be improved. This makes it possible to reduce the weight of the car and also to increase its size, thereby increasing the space saving potential of the elevator. A contact angle of over 180° between the traction sheave and the hoisting rope is achieved by using a diverting pulley or diverting pulleys. The compensating device, which compensates the rope elongation, maintains a suitable $T_1/T_2$ ratio to ensure a grip between the hoisting rope and the traction sheave that is sufficient for the operation and safety of the elevator. On the other hand, it is essential for the operation and safety of the elevator that the rope below the elevator car in an elevator solution without counterweight be kept at a sufficient tension. In addition, the invention makes it possible to limit the use of the elevator in its normal operating area, which is the area within which the elevator can be safely operated. It is possible to ensure especially the overhead safety space required for the elevator car and, if necessary, the invention can also be used to define and delimit other functional areas for the elevator. For example, it is possible to define for the elevator a maximum operating area in the direction of the upper part of the elevator shaft so that the elevator can not be driven upwards beyond this area, which area is larger than the overhead safety space required when work is being carried out from the top of the elevator car. In addition to this, it is possible to define a second area, which is an area where a larger overhead safety space is defined, in which case the elevator can not be driven as far up as in the maximum operating area, and which safety space meets the requirements stipulated e.g. when work is being carried out from the top of the elevator car.

Figure 2:
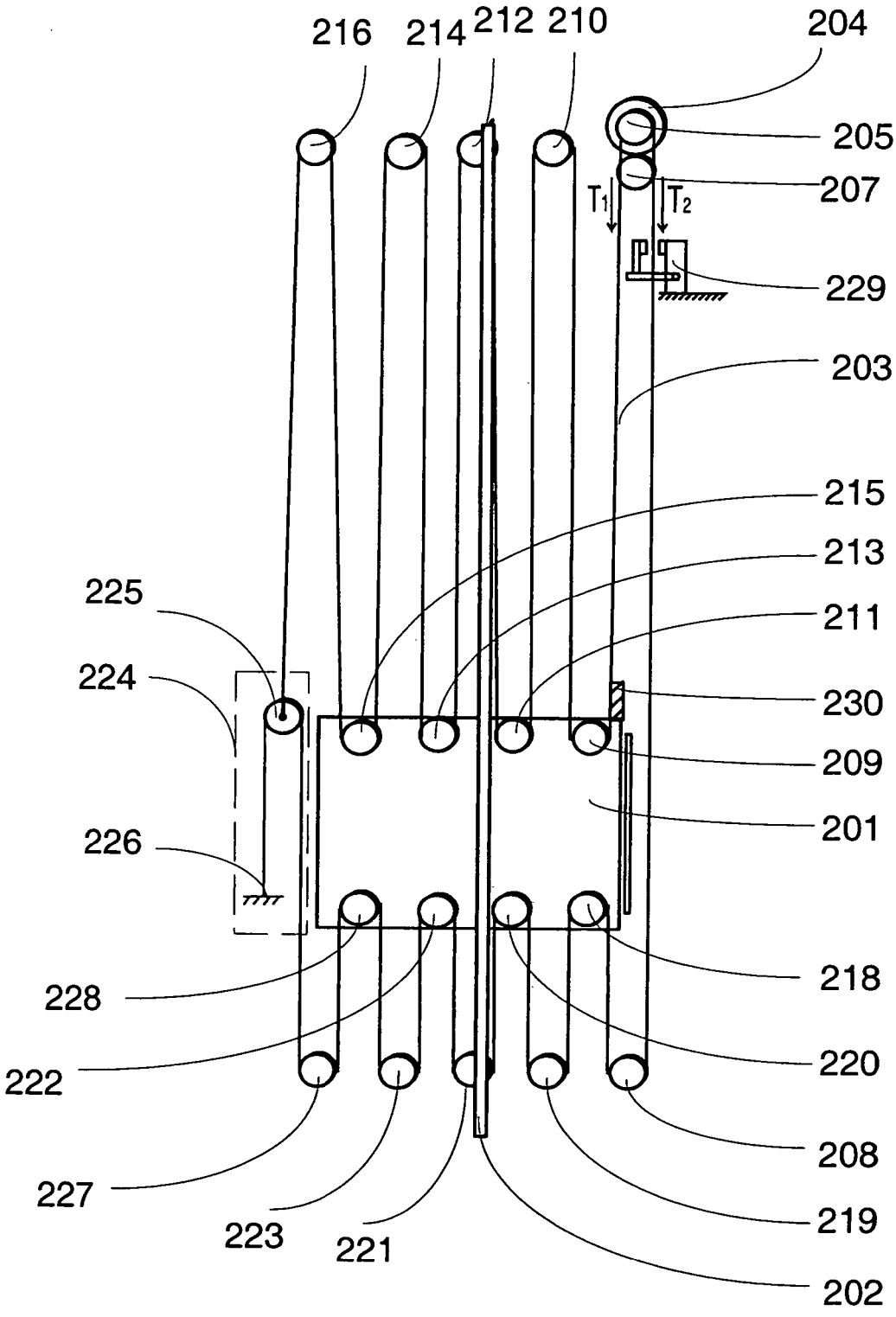
Figure 3:
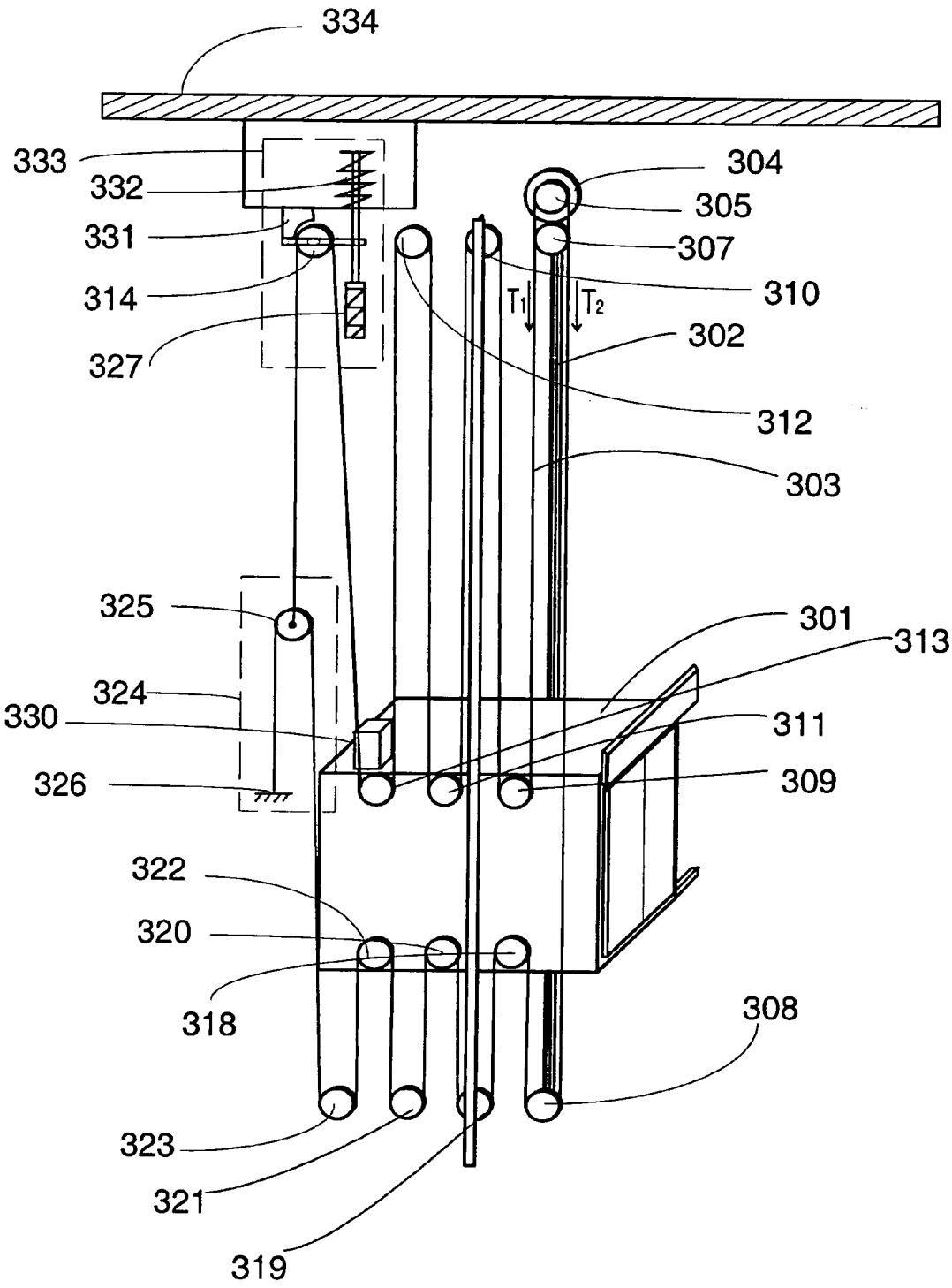

In the following, the invention will be described in detail with reference to a few embodiment examples and the attached drawings, wherein FIG. 1 presents a diagrammatic view of a traction sheave elevator without counterweight according to the invention, FIG. 2 presents a diagrammatic view of a second traction sheave elevator without counterweight according to the invention, FIG. 3 presents a diagrammatic view of a third traction sheave elevator without counterweight according to the invention.

FIG. 1 is a diagrammatic representation of the structure of an elevator according to the invention. The elevator is preferably an elevator without machine room and with a drive machine 4 placed in the elevator shaft. The elevator presented in the figure is a traction sheave elevator with machine above and without counterweight. The hoisting ropes 3 of the elevator run as follows: One end of the hoisting ropes 3 is fastened to a fixing point 16 on a lever 15 immovably fitted fast on the elevator car 1, said point 16 being at a distance from the pivot 17 connecting the lever to the elevator car 1. Thus, in the situation illustrated in FIG. 1, the lever 15 used as a compensating device is pivoted on the elevator car 1 at fastening point 17. From the fixing point 16, the hoisting ropes 3 go upwards and meet a diverting pulley 14 mounted above the elevator car 1 in the elevator shaft, preferably in the upper part of the elevator shaft, from which diverting pulley the ropes 3 go further downwards to a diverting pulley 13 on the elevator car, and from which diverting pulley 13 the ropes go again upwards to a diverting pulley 12 fitted in the upper part of the elevator shaft above the elevator car. From diverting pulley 12, the ropes go further downwards to a diverting pulley 11 mounted on the elevator car, and having passed around this diverting pulley the ropes go further upwards to a diverting pulley 10 fitted in the upper part of the of the elevator shaft, and having passed around it the ropes go back downwards to diverting pulley 9 fitted on the elevator car. Having passed around diverting pulley 9, the hoisting ropes 3 go further upwards to the traction sheave 5 of the drive machine 4 placed in the upper part of the of the elevator shaft, having first passed via a diverting pulley 7 in "tangential contact" with it. This means that the ropes 3 going from the traction sheave 5 to the elevator car 1 pass via the rope grooves of diverting pulley 7 and the deflection of the rope 3 caused by the diverting pulley 7 is very small. It could be stated that the ropes going from the traction sheave 5 only run in "tangential contact" with the diverting pulley 7. Such "tangential contact" functions as a solution damping vibrations of the outgoing ropes and it can also be applied in other roping solutions. The ropes pass around the traction sheave 5 of the drive machine 4 along the rope grooves of the traction sheave 5. From the traction sheave 5, the ropes go further downwards to diverting pulley 7, pass around it along the rope grooves of the diverting pulley 7 and return back up to the traction sheave 5, passing around it along the rope grooves of the traction sheave. From the traction sheave 5, the ropes 3 go further downwards in "tangential contact" with diverting pulley 7 past the elevator car to a diverting pulley 8 placed in the lower part of the elevator shaft, passing around it along rope grooves provided on it. From the diverting pulley 8 in the lower part of the elevator shaft, the ropes go further upwards to a diverting pulley 18 on the elevator car, from which pulley the ropes 3 go further to a diverting pulley 19 in the lower part of the elevator shaft and further back upwards to a diverting pulley 20 on the elevator car, from which pulley the ropes go further to a diverting pulley 22 on the elevator car, from which pulley the ropes 3 go further to a diverting pulley 23 in the lower part of the elevator shaft. From diverting pulley 23, the ropes 3 go further to the lever 15, which is fixedly pivoted on the elevator car 1 at point 17 and to which lever 15 the second end of the ropes 3 is immovably fixed at point 24 at a distance b from the pivot 17. In the case illustrated in FIG. 1, the hoisting machine and diverting pulleys are preferably all placed on one and the same side of the elevator car, but they may also be located on different sides of the elevator car. This solution is particularly advantageous in the case of a rucksack-type elevator solution, wherein the components in question are located behind the elevator car in the space between the elevator car and the back wall of the shaft. The roping between diverting pulley 7 and the traction sheave 5 is referred to as Double Wrap roping, in which roping the hoisting ropes are passed around the traction sheave twice and/or more than twice. In this way the contact angle can be increased in two and/or more stages. For example, the contact angle between the traction sheave 5 and the hoisting ropes 3 achieved in the embodiment presented in FIG. 1 is 180° +180°, i.e. 360°. The Double Wrap roping presented the figure can also be arranged in another way, such as e.g. by placing diverting pulley 7 on the side of the traction sheave 5, so that as the hoisting ropes run twice around the traction sheave, the contact angle will be 180°+90°, i.e. 270°, or by placing the diverting pulley at some other suitable point. An advantageous solution is to place the traction sheave 5 and diverting pulley 7 in such manner that the diverting pulley 7 simultaneously functions as a guide of the hoisting ropes 3 and as a damping pulley. Diverting pulleys 14,13,12,11,10,9,7 together with the traction sheave 5 of the hoisting machine 4 form the suspension above the elevator car, which has the same suspension ratio as the suspension below the elevator car, which suspension ratio in FIG. 1 is 7:1. The rope portions going from the traction sheave 5 in the direction of the rope portion above the elevator car 1 are under a first rope tension ($T_1$). Diverting pulleys 8,18,19,20,21,22,23 form the suspension and rope portion below the elevator car. The rope portions going from the traction sheave in the direction of the rope portion below the elevator car are under a second rope tension ($T_2$). The hoisting machine 4 and traction sheave 5 of the elevator and/or the diverting pulleys 7,10,12,14 in the upper part of the elevator shaft may be mounted in place on a frame structure formed by the guide rails 2 or on a beam structure at the upper end of the elevator shaft or separately in the elevator shaft or on some other appropriate mounting arrangement. The diverting pulleys in the lower part of the elevator shaft may be mounted in place on a frame structure formed by the guide rails 2 or to a beam structure placed at the lower end of the elevator shaft or separately in the lower part of the elevator shaft or on some other appropriate mounting arrangement. The diverting pulleys on the elevator car may be mounted in place on the frame structure of the elevator car 1, e.g. on the car frame, or to a beam structure or beam structures in the elevator car or separately on the elevator car or some other appropriate mounting arrangement. The diverting pulleys may also be of a modular construction, e.g. such that they are separate modular structures, such as e.g. cassette-type structures, which are fitted in place on the shaft structure of the elevator, on the structures of the elevator car and/or car frame or in some other appropriate place in the elevator shaft or in its vicinity or in conjunction with the elevator car. The diverting pulleys placed in the elevator shaft and the hoisting machine equipment and/or the diverting pulleys fitted in place in conjunction with the elevator car may be placed either all on one side of the elevator car in the space between the elevator car and the elevator shaft or in a desired manner on different sides of the elevator car. The roping between the traction sheave 4 and diverting pulley 7 may also be implemented in other ways than as Double Wrap roping, e.g. as Single Wrap roping, in which case diverting pulley 7 is not necessarily needed at all, as ESW roping (Extended Single Wrap) or by using some other corresponding roping solution appropriate for the purpose.

The drive machine 4 placed in the elevator shaft is preferably of a flat construction, in other words, the machine has a small thickness dimension as compared to its width and/or height, or at least the machine is slim enough to be accommodated between the elevator car and a wall of the elevator shaft. The machine may also be placed differently, e.g. by disposing the slim machine partly or completely between an imaginary extension of the elevator car and a shaft wall. In the elevator of the invention, it is possible to use a drive machine 4 of almost any type and design that fits into the space intended for it. For example, it is possible to use a geared or a gearless machine. The machine may be of a compact and/or flat size. In the suspension solutions according to the invention, the rope speed is often high as compared to the speed of the elevator, so it is possible to use even unsophisticated machine types as the basic machine solution. The elevator shaft is advantageously provided with equipment required for the supply of power to the motor driving the traction sheave 5 as well as equipment needed for elevator control, both of which can be placed in a common instrument panel 6 or mounted separately from each other or integrated partly or wholly with the drive machine 4. A preferable solution is a gearless machine comprising a permanent magnet motor. The drive machine may be fixed to a wall of the elevator shaft, to the ceiling, to a guide rail or to some other structure, such as a beam or frame. In the case of an elevator with machine below, a further possibility is to mount the machine on the bottom of the elevator shaft. FIG. 1 illustrates a preferred suspension solution in which the suspension ratio of the diverting pulleys above the elevator car and the diverting pulleys below the elevator car is the same 7:1 suspension in both cases. To visualize this ratio in practice, it means the ratio of the distance traveled by the hoisting rope to the distance traveled by the elevator car. The suspension arrangement above the elevator car 1 is implemented by means of diverting pulleys 14,13,12,11,10,9 and the suspension arrangement below the elevator car 1 is implemented by means of diverting pulleys 23,22,21,20,19,18,8. Other suspension solutions can also be used to implement the invention. The elevator of the invention can also be implemented as a solution comprising a machine room, or the machine may be mounted so as to be movable together with the elevator.

The function of the lever 15 pivoted on the elevator car 1 at point 17 in FIG. 1 and serving as a compensating device is to equalize and/or compensate rope tension and/or rope elongation and/or to render the ratio between the first and second rope tensions ($T_1/T_2$) substantially constant. It is essential to the operation and safety of the elevator that a sufficient tension be maintained in the lower rope portion, which refers to that part of the hoisting rope which is below the elevator car. By means of the lever arrangement 15 illustrated in FIG. 1, the tensioning of the hoisting rope can be implemented in such manner that the ratio $T_1/T_2$ between the rope forces $T_1$ and $T_2$ acting in different directions on the traction sheave 5 can be kept at a desired constant value, which may be e.g. 2. This ratio to be kept constant can be varied by varying the distances a and b, because $T_1/T_2=b/a$. When odd suspension ratios are used in the suspension of the elevator car, the lever 15 is pivoted on the elevator car, and when even suspension ratios are used, the lever 15 used as an equalizing device is pivoted on the elevator shaft.

FIG. 1 presents a device according to the invention that stops/prevents an elevator from moving too far up. From the reduction or disappearance of rope tension $T_2$ it follows that the friction between the traction sheave and the hoisting ropes is lost, so that it becomes impossible to hoist the elevator car 1. In FIG. 1 a stopper element 25 arranged to meet the lever 15 used as a compensating device has been fitted in the elevator shaft at a point 26 such that by means of the stopper element a desired overhead space is ensured between the between the elevator car and the ceiling of the elevator shaft and the elevator car can be prevented from moving upwards beyond the desired point in the elevator shaft. When the elevator car 1 is moving upwards and reaches the point beyond which the motion of the elevator car is to be prevented, the lever 15 used as the compensating device of the elevator meets the stopper element 25, which turns the lever 15 downwards, thereby slackening the rope portion below the elevator car 1, as a result of which rope tension $T_2$ disappears and the ratio $T_1/T_2$ between the first and the second rope tensions increases. Consequently, the motion of the elevator car 1 is stopped. In addition to stopper element 25, the elevator of the invention can also be provided with a second stopper element, which can be so fitted in the elevator shaft that it can be used to guarantee a sufficient safety space above the elevator car e.g. during maintenance work. The second stopper element can be arranged to be set into the safety position, i.e. the position in which it will meet the compensating device 15, either manually or electrically, e.g. upon being activated via a service box provided on the car top. When the serviceman leaves the car top and maintenance operation is terminated, the stopper is returned either manually or electrically to the final position in which it no longer meets the compensating device 15. The second stopper element may be provided with a safety switch that prevents normal operation of the elevator when the stopper is in the safety position.

FIG. 2 presents a general illustration of a traction sheave elevator without counterweight according to the invention, wherein the elevator car is prevented from moving too far up in the elevator shaft. The elevator presented the figure is an elevator according to FIG. 1, with the difference that the elevator in FIG. 2 has a suspension ratio of 8:1 and is provided with a different compensating device 224. The elevator is a traction sheave elevator without counterweight, with an elevator car 1 moving along guide rails 202. In elevators with a large hoisting height, the elongation of the hoisting rope involves a need to compensate the rope elongation, which has to be done reliably within certain allowed limit values. It is essential in respect of elevator operation and safety that the rope portion below the elevator car be kept sufficiently tight. In the rope force compensating device 224 presented in FIG. 2, a very long movement is achieved for the compensation of rope elongation. This permits the compensation of even large elongations. The compensating device 224 according to the invention presented in FIG. 2 produces a constant ratio $T_1/T_2$ between the rope forces $T_1$ and $T_2$ acting on the traction sheave. In the case illustrated in FIG. 2, the ratio $T_1/T_2$ is about 2/1. With even suspension ratios above and below the elevator car, the compensating device 224 is fitted in the elevator shaft or in some other corresponding appropriate place not in conjunction with the elevator car, and with odd suspension ratios above and below the elevator car the compensating device 224 is fitted in conjunction with the elevator car 1.

In FIG. 1, the hoisting ropes run as follows: One end of the hoisting ropes 3 is fixed to a diverting pulley 225 fitted to hang on a rope portion coming downwards from diverting pulley 216. Diverting pulleys 216 and 225 together with the fixing point 226 of the second end of the hoisting rope constitute a rope force equalizing device 224. This compensating device 224 is fitted in place in the elevator shaft. From diverting pulley 225, the hoisting ropes 203 go upwards and meet a diverting pulley 216 placed above the elevator car in the elevator shaft, preferably in the upper part of the elevator shaft, passing around it along rope grooves provided on the diverting pulley 216. From diverting pulley 216, the ropes go further downwards to a diverting pulley 215 fitted in place on the elevator car, and having passed around this pulley the ropes go further upwards to a diverting pulley 214 fitted in place in the upper part of the elevator shaft. Having passed around diverting pulley 214, the ropes come again downwards to a diverting pulley 213 fitted in place on the elevator car, pass around it and go further upwards to a diverting pulley 212 fitted in place in the upper part of the elevator shaft, and having passed around this pulley the hoisting ropes 203 go further downwards to a diverting pulley 211 fitted in place on the elevator car. Having passed around this pulley 211, the hoisting ropes go further upwards to a diverting pulley 210 fitted in place in the upper part of the of the elevator shaft, and having passed around it the hoisting ropes 203 go further downwards to a diverting pulley 209 fitted in place on the elevator car, and having passed around this pulley the ropes 203 go further upwards in tangential contact with diverting pulley 207 to the traction sheave 205. Diverting pulley 207 is preferably fitted near and/or in conjunction with the hoisting machine 204. Between diverting pulley 207 and the traction sheave 205 of the hoisting machine 204, FIG. 2 shows Double Wrap (DW) roping, as in connection with FIG. 1. Diverting pulleys 216,214,213,212,211,210,209,207 together with the traction sheave 205 of the hoisting machine 204 form the suspension above the elevator car, which has the same suspension ratio as the suspension below the elevator car, which suspension ratio in FIG. 2 is 8:1. The rope portions going from the traction sheave in the direction of the suspension above the elevator car are under a first rope tension ($T_1$). From the traction sheave 205, the ropes go further in tangential contact with diverting pulley 207 to diverting pulley 208, which is preferably fitted in place in the lower part of the elevator shaft. Having passed around diverting pulley 208, the ropes 203 go further upwards to a diverting pulley 218 fitted in place on the elevator car, and having passed around said diverting pulley 218 the ropes go further downwards to a diverting pulley 219 in the lower part of the elevator shaft and, having passed around this pulley, return to a diverting pulley 220 fitted in place on the elevator car. Having passed around diverting pulley 220, the hoisting ropes 203 go further downwards to a diverting pulley 221 fitted in place in the lower part of the elevator shaft, pass around it and go further upwards to a diverting pulley 222 on the elevator car. Having passed around diverting pulley 222, the hoisting ropes 203 go further downwards to a diverting pulley 223 fitted in place in the lower part of the elevator shaft, pass around it and go further upwards to a diverting pulley 228 on the elevator car having passed around diverting pulley 228, the hoisting ropes 203 go further downwards to a diverting pulley 227 fitted in place in the lower part of the elevator shaft, and having passed around it the hoisting ropes go further upwards to the diverting pulley 225 of the compensating device, pass around it and go further to the fixing point 226 of their second end, which is located in a suitable place in the elevator shaft. Diverting pulleys 208, 218,219,220,221,222,223,228,227 form the suspension and rope portion below the elevator car, which rope portion is subject to a second rope tension $T_2$.

The elevator presented in FIG. 2 comprises a compensating device designed to equalize and/or compensate the rope tension and/or rope elongation and/or to render the ratio of the first and the second rope tensions ($T_1/T_2$) substantially constant, the action of the compensating device being produced by the motion of diverting pulley 225. The diverting pulley 225 moves through a limited distance, thereby compensating elongations of the hoisting ropes 303. In addition, this arrangement keeps the rope tension over the traction sheave 205 at a constant level, so that the $T_1/T_2$ ratio between the rope tensions in the situation illustrated in FIG. 2 is about 2/1. It is also possible to implement the compensating device 224 in other ways besides that described in the example, such as e.g. by using more complex suspension arrangements and larger numbers of diverting pulleys in the compensating device, thus providing different suspension ratios between the diverting pulleys of the compensating device. In the elevator without counterweight presented in FIG. 2, the elevator must be prevented from being driven up to the shaft's ceiling to obviate injury to installers who may be working on the car top and to prevent damage to the elevator. If a traditional buffer is used, it will be necessary to use heavy and expensive solutions and structures. The arrangement of the invention for preventing the elevator from being driven up to the ceiling as illustrated in FIG. 2 is advantageously placed as close to the machine 24 as possible, so that the delay caused by the elongation of the hoisting rope 203 is as small as possible and the stopping distance as short as possible. This placement is also preferable because the coercivity to the hoisting rope is minimized. When the elevator car 21 comes up and reaches the area where it has to be stopped at the latest, the gripping element 229 acting on the ropes grips the hoisting rope 203 and stops the motion of the rope. The gripping element 229 is closed when it is hit by a guard 230, preferably a buffer, fitted on the elevator car, whereupon the gripping element 229 will stop the motion of the rope. In this situation, the compensating device 224 no longer works. In addition, as the traction sheave is further supplying rope into the hoisting rope portion on the side of the second rope tension $T_2$, the gripping element gripping the rope has the effect that, due to the internal stiffness of the rope, the second rope tension $T_2$ in the rope portion above the elevator car is reduced so much that the frictional force between the traction sheave and the hoisting ropes disappears and the traction sheave starts slipping, the motion of the elevator car being simultaneously stopped. The gripping element 229 presented in FIG. 2 is so arranged that when the car starts moving in the downward direction, the gripping element 229 will release the rope, and the compensating device 224 and therefore the elevator again works in the normal way. As to the structure of the gripping element 229, it may be e.g. an arrangement comprising a first part which has been designed to meet the buffer 230 of the elevator car and which, upon meeting the buffer, is pressed against a second part of the gripping element, to which the first part is pivotally connected. As a consequence of this, the set of hoisting ropes is caught between the first part and second parts of the gripping element and its motion is stopped while the rope portion below the elevator car is immediately slackened. The gripping element is preferably fitted in place e.g. in the elevator shaft.

FIG. 3 presents an elevator according to FIG. 2, with the difference that in the elevator in FIG. 3, the suspension ratio is 6:1. FIG. 3 presents a compensating device 324 corresponding to that presented in connection with FIG. 2 and the passage of the hoisting ropes 303 is implemented in the same way. For example, hoisting ropes 303 pass from diverting pulley 325 of the compensating device 324 to diverting pulleys 314, 313, 312, 311, 310, and 309, and to traction sheave 305 of drive machine 304. The drive machine 304 and traction sheave 305 of the elevator and/or the diverting pulleys 307, 310, 312, 314 in the upper part of the elevator shaft is mounted in place on a frame structure formed by the guide rails 302 or on a beam structure at the upper end of the elevator shaft or separately in the elevator shaft or on some other appropriate mounting arrangement. From the traction sheave 305, hoisting ropes 303 may pass to diverting pulley 307 and back up to traction sheave 305. Hoisting ropes may then pass to diverting pulleys 308, 318, 319, 320, 321, 322, and 323, to diverting pulley 325, and to fixing point 326. The difference in FIG. 3 with respect to FIG. 2 is in the equipment used to prevent and/or stop the motion of the elevator car 301 and in the part the effect of said equipment is applied to. In the elevator without counterweight presented in FIG. 3, the elevator is prevented from being driven up to the ceiling by means of a gripping element 333 whose action is applied to a hoisting rope portion near the compensating device 324, preferably to a diverting pulley 314 placed in the upper part of the of the elevator shaft, the hoisting ropes being passed around said diverting pulley and then going further to the diverting pulley 325 of the compensating device. When the elevator car 301 comes up and reaches the area where the motion of the elevator car has to be stopped at the latest, the gripping element 333 stops the motion of the rope. The gripping element stops the rope whose second end is connected to the diverting pulley 325 of the compensating device 324. After the gripping action of the gripping element 333, the compensating device 324 no longer works, and consequently the first rope tension $T_1$ acting over the traction sheave 305 increases and the second rope tension $T_2$decreases, as a result of which the hoisting rope portion below the elevator car is immediately slackened and therefore the frictional force needed in the machine 304 between the machine 304 and the traction sheave 305 disappears and the traction sheave 305 starts slipping. The gripping element 333 preferably works automatically, so that when the elevator car 301 is set in motion in the downward direction the gripping element 333 releases the rope and the compensating device of the elevator again works normally. In FIG. 3 the gripping element 333 is preferably fitted on the ceiling of the elevator shaft and comprises a first part 334 designed to meet a stopper 330, preferably a buffer mounted on the elevator car. The first part may comprise a device 327 which limits the braking force of the impact of the elevator car and which can be utilized to influence the braking speed of the gripping element 333 and which may also be provided with a second braking spring 332 which can be utilized to influence the speed of braking action of the gripping element 333 and its release when the elevator is set in motion in the downward direction after the action of the gripping element. In addition, the gripping element comprises a second part 331, with respect to which the first part is movably mounted. The first part also comprises an intermediate beam, on which is mounted a diverting pulley 314. When the buffer 330 of the elevator meets the first part of the gripping element 333, the movement of the first part can be used to move diverting pulley 314, which presses the hoisting rope against the second part 331 of the gripping element, the result of which is that the motion of the rope is stopped and the motion of the elevator is stopped as described above.

A preferred embodiment of the elevator of the invention is an elevator without machine room and with machine above, in which the drive machine has a coated traction sheave and which elevator has thin and strong hoisting ropes of substantially round cross-section. The contact angle of the hoisting ropes on the traction sheave of the elevator is greater than 180° and is implemented using DW roping in a drive machine having a traction sheave and a diverting pulley, in which drive machine the traction sheave and the diverting pulley are ready fitted at a correct angle relative to each other. The drive machine is fitted in place on the elevator guide rails. The elevator is implemented without counterweight with a suspension ratio of 8:1 so that both the roping suspension ratio above the elevator car and the roping suspension ratio below the elevator car is 8:1, and that the ropes run in the space between one of the walls of the elevator car and a wall of the elevator shaft. The elevator has a compensating device that keeps the ratio of the rope tensions $T_1/T_2$ equal to about the ratio of 2:1. The compensating device of the elevator comprises at least one slack rope prevention device for preventing uncontrolled slackening of the hoisting ropes and/or uncontrolled motion of the compensating device, said slack rope prevention device being preferably a buffer. The motion of the elevator is stopped and/or prevented by increasing the ratio of the first rope tension ($T_1$) to the second rope tension ($T_2$), as a consequence of which the friction between the traction sheave and the hoisting ropes is removed.

It is obvious to the person skilled in the art that different embodiments of the invention are not limited to the examples described above, but that they may be varied within the scope of the claims presented below. For example, the number of times the hoisting ropes are passed between the diverting pulleys in the upper part of the elevator shaft and those on the elevator car and between the diverting pulleys in the lower part of the elevator shaft and those on the elevator car may vary so that a desired suspension ratio is achieved both above and below the elevator car. Applications are generally so implemented that the ropes go to the elevator car from above as many times as from below, so that the suspension above the elevator car and the suspension below the elevator car have the same suspension ratios. In accordance with the examples described above, a skilled person can vary the embodiment of the invention as the traction sheaves and diverting pulleys, instead of being coated metal pulleys, may also be uncoated metal pulleys or uncoated pulleys made of some other material suited to the purpose.

It is further obvious to the person skilled in the art that the metallic traction sheaves and rope wheels used as diverting pulleys in the invention, which are coated with a non-metallic material at least in the area of their grooves, may be implemented using a coating material consisting of e.g. rubber, polyurethane or some other material suited to the purpose.

It is obvious to the skilled person that the elevator of the invention can be implemented using as hoisting ropes almost any flexible hoisting means, e.g. a flexible rope of one or more strands, a flat belt, a cogged belt, a trapezoidal belt or some other type of belt suited to the purpose. It is also obvious to the person skilled in the art that, instead of using ropes with a filler, the invention can be implemented using ropes without a filler, which are either lubricated or unlubricated. In addition, it is also obvious to the skilled person that the ropes may be twisted in many different ways.

It is also obvious to the person skilled in the art that the elevator of the invention can be implemented using other types of roping between the traction sheave and the diverting pulley/diverting pulleys to increase the contact angle $\alpha$ than the roping arrangements described above as examples. For example, it is possible to arrange the diverting pulley/diverting pulleys, traction sheave and hoisting ropes in other ways than in the roping examples presented. It is further obvious to the skilled person that the elevator of the invention may also be provided with a counterweight, in which elevator, for example, the counterweight preferably has a weight below that of the car and is suspended on separate ropes, the elevator car is supported partly by the hoisting ropes and partly by the counterweight and its roping.

The invention claimed is:

1. An elevator, comprising:

an elevator car;

a set of hoisting ropes;

a traction sheave;

a compensating device;

a stopper; and a gripping element;

wherein the set of hoisting ropes comprises one rope or a number of parallel ropes, wherein the elevator car is supported by the set of hoisting ropes, wherein the traction sheave moves the elevator car using the set of hoisting ropes, wherein the elevator includes rope portions of the set of hoisting ropes going upwards from the elevator car, wherein the elevator includes rope portions of the set of hoisting ropes going downwards from the elevator car, wherein a rope portion going from the traction sheave in a direction of the rope portions going upwards from the elevator car is under a first rope tension ($T_1$), wherein a rope portion going from the traction sheave in a direction of the rope portions going downwards from the elevator car is under a second rope tension ($T_2$), wherein the compensating device is adapted to do one or more of the following:

equalize rope tension;

compensate the rope tension;

equalize rope elongation;

compensate the rope elongation; and render a ratio of the first rope tension ($T_1$) to the second rope tension ($T_2$) as equal to about an initial value of the first rope tension ($T_1$) divided by an initial value of the second rope tension ($T_2$)

wherein the stopper is provided on the elevator car, wherein the gripping element comprises at least a first part and a second part, said first part includes a diverting pulley, wherein said set of hoisting ropes is positioned between said gripping element and said diverting pulley of the first part wherein said first part is movably mounted with respect to said second part wherein when the stopper meets the first part, said first part is moved toward said second part to grip said set of hoisting ropes to prevent, stop, or prevent and stop motion of the elevator car, and wherein when the elevator car is set in motion in the upward direction and reaches an area where the motion of the elevator car has to be stopped, the gripping element stops the motion of the hoisting ropes, whose one end is connected to a diverting pulley of the compensating device, whereby via a gripping action of the gripping element, the compensating device is non-operational such that the first rope tension ($T_1$) acting over the traction sheave increases and the second rope tension ($T_2$) decreases, and when the elevator car is set in motion in the downward direction, the gripping element releases the hoisting ropes and the compensating device is again operational.

2. The elevator of claim 1, wherein when the elevator car starts moving downwards after the second part has gripped the set of hoisting ropes, the second part stops acting on the set of hoisting ropes.

3. The elevator of claim 1, wherein the compensating device of the elevator comprises one or more diverting pulleys.

4. The elevator of claim 1, further comprising:

two or more diverting pulleys on the elevator car;

wherein at least one of the two or more diverting pulleys on the elevator car serves to increase a suspension ratio above the elevator car, wherein the set of hoisting ropes go upwards from the at least one of the two or more diverting pulleys on the elevator car that serves to increase the suspension ratio above the elevator car, wherein at least one of the two or more diverting pulleys on the elevator car serves to increase a suspension ratio below the elevator car, and wherein the set of hoisting ropes go downwards from the at least one of the two or more diverting pulleys on the elevator car that serves to increase the suspension ratio below the elevator car.

5. The elevator of claim 1, wherein the elevator is an elevator without counterweight.

6. A method for preventing, stopping, or preventing and stopping motion of an elevator car of an elevator, the method comprising:

gripping a set of hoisting ropes of the elevator when a stopper provided on the elevator car meets a gripping element of the elevator;

the elevator car is at least partially supported by the set of hoisting ropes, wherein the set of hoisting ropes comprises one rope or a number of parallel ropes, wherein a traction sheave moves the elevator car using the set of hoisting ropes, wherein the elevator includes rope portions of the set of hoisting ropes going upwards from the elevator car, wherein the elevator includes rope portions of the set of hoisting ropes going downwards from the elevator car, wherein a rope portion going from the traction sheave in a direction of the rope portions going upwards from the elevator car is under a first rope tension ($T_1$), wherein a rope portion going from the traction sheave in a direction of the rope portions going downwards from the elevator car is under a second rope tension ($T_2$), wherein a compensating device is adapted to do one or more of the following:

equalize rope tension;

compensate the rope tension;

equalize rope elongation;

compensate the rope elongation; and render a ratio of the first rope tension ($T_1$) to the second rope tension ($T_2$) as equal to about an initial value of the first rope tension ($T_1$) divided by an initial value of the second rope tension ($T_2$)

wherein the gripping element comprises at least a first part and a second part, said first part includes a diverting pulley, wherein said set of hoisting ropes is positioned between said gripping element and said diverting pulley of the first part wherein said first part is movably mounted with respect to said second part wherein when the stopper meets the first part, said first part is moved toward said second part to grip said set of hoisting ropes to prevent, stop, or prevent and stop motion of the elevator car, and wherein when the elevator car is set in motion in the upward direction and reaches an area where the motion of the elevator car has to be stopped, the gripping element stops the motion of the hoisting ropes, whose one end is connected to a diverting pulley of the compensating device, whereby via a gripping action of the gripping element, the compensating device is non-operational such that the first rope tension ($T_1$) acting over the traction sheave increases and the second rope tension ($T_2$) decreases, and when the elevator car is set in motion in the downward direction, the gripping element releases the hoisting ropes and the compensating device is again operational.

7. The method of claim 6, wherein when the elevator car starts moving downwards after the second part has gripped the set of hoisting ropes, the second part stops acting on the set of hoisting ropes.

8. The method of claim 6, wherein the elevator further includes:

two or more diverting pulleys on the elevator car;

wherein at least one of the two or more diverting pulleys on the elevator car serves to increase a suspension ratio above the elevator car, wherein the set of hoisting ropes go upwards from the at least one of the two or more diverting pulleys on the elevator car that serves to increase the suspension ratio above the elevator car, wherein at least one of the two or more diverting pulleys on the elevator car serves to increase a suspension ratio below the elevator car, and wherein the set of hoisting ropes go downwards from the at least one of the two or more diverting pulleys on the elevator car that serves to increase the suspension ratio below the elevator car.

9. The method of claim 6, wherein the elevator is an elevator without counterweight.

10. An elevator, comprising:

an elevator car;

a set of hoisting ropes;

a traction sheave;

a compensating device;

a stopper; and a gripping element;

wherein the set of hoisting ropes comprises one rope or a number of parallel ropes, wherein the elevator car is supported by the set of hoisting ropes, wherein the traction sheave moves the elevator car using the set of hoisting ropes, wherein the elevator includes rope portions of the set of hoisting ropes going upwards from the elevator car, wherein the elevator includes rope portions of the set of hoisting ropes going downwards from the elevator car, wherein a rope portion going from the traction sheave in a direction of the rope portions going upwards from the elevator car is under a first rope tension ($T_1$), wherein a rope portion going from the traction sheave in a direction of the rope portions going downwards from the elevator car is under a second rope tension ($T_2$), wherein the compensating device is adapted to do one or more of the following:

equalize rope tension;

compensate the rope tension;

equalize rope elongation;

compensate the rope elongation; and render a ratio of the first rope tension ($T_1$) to the second rope tension ($T_2$) substantially constant, wherein the stopper is provided on the elevator car, wherein the gripping element comprises at least a first part and a second part, said first part includes a diverting pulley, wherein said set of hoisting ropes is positioned between said gripping element and said diverting pulley of the first part wherein said first part is movably mounted with respect to said second part, wherein when the stopper meets the first part, said first part is moved toward said second part to grip said set of hoisting ropes to prevent, stop, or prevent and stop motion of the elevator car, and wherein when the elevator car is set in motion in the upward direction and reaches an area where the motion of the elevator car has to be stopped, the gripping element stops the motion of the hoisting ropes, whose one end is connected to a diverting pulley of the compensating device, whereby via a gripping action of the gripping element, the compensating device is non-operational such that the first rope tension ($T_1$) acting over the traction sheave increases and the second rope tension ($T_2$) decreases, and when the elevator car is set in motion in the downward direction, the gripping element releases the hoisting ropes and the compensating device is again operational.

11. The elevator of claim 10, wherein when the elevator car starts moving downwards after the second part has gripped the set of hoisting ropes, the second part stops acting on the set of hoisting ropes.

12. The elevator of claim 10, further comprising:

two or more diverting pulleys on the elevator car;

wherein at least one of the two or more diverting pulleys on the elevator car serves to increase a suspension ratio above the elevator car, wherein the set of hoisting ropes go upwards from the at least one of the two or more diverting pulleys on the elevator car that serves to increase the suspension ratio above the elevator car, wherein at least one of the two or more diverting pulleys on the elevator car serves to increase a suspension ratio below the elevator car, and wherein the set of hoisting ropes go downwards from the at least one of the two or more diverting pulleys on the elevator car that serves to increase the suspension ratio below the elevator car.

13. The elevator of claim 10, wherein the elevator is an elevator without counterweight.

* * * * *